US006336522B1

(12) United States Patent
Fujita et al.

(10) Patent No.: US 6,336,522 B1
(45) Date of Patent: Jan. 8, 2002

(54) DECK ELEVATOR CAR WITH SPEED CONTROL

(75) Inventors: Yoshiaki Fujita; Hideya Kohara, both of Tokyo; Koichi Mishima, Kanagawa-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/697,650

(22) Filed: Oct. 27, 2000

(30) Foreign Application Priority Data

Oct. 29, 1999 (JP) ..... 11-308084
Apr. 25, 2000 (JP) ..... 00-124008

(51) Int. Cl.[7] ..... B66B 1/28
(52) U.S. Cl. ..... 187/380; 187/902; 187/293
(58) Field of Search ..... 187/380, 382, 187/391, 394, 902, 293, 291, 284

(56) References Cited

U.S. PATENT DOCUMENTS 5,220,981 A * 6/1993 Kahkipuro et al. ..... 187/16
5,861,587 A * 1/1999 Powell et al. ..... 187/382
5,907,136 A * 5/1999 Hongo et al. ..... 187/277
6,161,652 A * 12/2000 Kostka et al. ..... 187/291
6,176,351 B1 * 1/2001 Ikeda et al. ..... 187/387

FOREIGN PATENT DOCUMENTS

| | | |
|---|---|---|
| JP | 10-279231 | 10/1998 |
| JP | 10-279232 | 10/1998 |
| JP | 11-314858 | 11/1999 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

The hoist control device controls the hoist in such a manner that once the speed change of the cage frame has accelerated at a fixed acceleration, constant speed is maintained, after which it decelerates at a fixed deceleration and stops. Meanwhile, the cage chamber position control device controls the cage chamber drive device in such a manner that once the speed change of the cage chamber driven by the cage chamber drive device has accelerated at a fixed acceleration, constant speed is maintained, after which it decelerates at a fixed deceleration and stops.

25 Claims, 15 Drawing Sheets

DECK ELEVATOR CAR WITH SPEED CONTROL

BACKGROUND TO THE INVENTION

1.Field of the Invention

The present invention relates to a double-deck elevator car whereby the raising and lowering of a cage frame comprising two vertically arranged cage chambers is controlled.

2. Description of the Related Art

Double-deck elevator cars are often used as a vertical means of transport within ultra-high-rise buildings and elsewhere in order to improve the efficient use of space. Capable of carrying large volumes of traffic, double-deck elevator cars comprise two vertically arranged cage chambers. With ordinary double-deck elevator cars, the distance between the two cage chambers is fixed, so that the height of all stories must be uniform if the upper and lower cage chambers are to land simultaneously.

Meanwhile, with the object of allowing the upper and lower cage chambers to land simultaneously where the height of the stories in a building is not uniform, double-deck elevator cars have been developed as disclosed in Japanese Laid-Open Patent Applications S48[1973]-76242 and H10[1998]-279231, wherein the distance between the upper and lower cage chambers is variable.

FIG. 1 is an explanatory diagram illustrating the double-deck elevator car disclosed in Japanese Laid-Open Patent Application S48[1973]-76242, wherein the distance between the cage chambers is variable. As FIG. 1 shows, two cage chambers (an upper cage chamber 2 and a lower cage chamber 4) are fitted within the cage chamber 1 of the double-deck elevator car, and a cage chamber drive device is fitted to one of them (the lower cage chamber 4 in the case of FIG. 1). The cage chamber drive device comprises a guide roller 5 fitted to the cage frame 3 of the lower cage, and an actuator 6 which drives the guide roller 5. The lower cage chamber 4 is driven by the actuator 6 while being guided by the guide roller 4. In this manner it is possible to alter the distance between the upper and lower cage chambers.

Similarly, FIG. 2 is an explanatory diagram illustrating the double-deck elevator car disclosed in Japanese Laid-Open Patent Application H10[1998]-279231, wherein the distance between the cage chambers is variable. As FIG. 2 shows, a crank 7, motor 8 and ball screw 9 are employed as the cage chamber drive device, and the upper and lower cage chambers are made to move in opposite directions while keeping their weights balanced. This makes it possible to alter the distance between the upper and lower cage chambers without consuming too much power. In other words, the upper cage chamber 2 and lower cage chamber 4 are attached to the crank 7, which is itself attached to the centre of the cage frame 1, and two chambers are driven by the motor 8 and ball screw 9 in mutually opposite directions while retaining balance by virtue of their respective weights.

In this manner, a cage chamber drive device is attached to either the upper cage chamber 2 or the lower cage chamber 4, which allows the height of the cage chambers to be altered, thus making it possible to vary the distance between them.

FIG. 3 illustrates a characteristic conventional speed pattern where the movable cage chamber is allowed to land by operating the cage chamber drive device after the double-deck elevator car stops. The characteristic curve S1 represents the running speed pattern of the hoist which drives the cage frame 1 of the double-deck elevator car, while the characteristic curve S3 represents the running speed pattern applied to the movable cage chamber by the cage chamber drive device. In this case the hoist drives the whole cage frame 1 and stops, after which it allows the movable cage chamber to land by driving it until the floor height of each story is matched.

FIG. 4 illustrates a characteristic conventional speed pattern where the cage chamber drive device is operated during the running of a double-deck elevator car in order to allow a movable cage chamber to land at a floor. The characteristic curve S1 represents the running speed pattern of the hoist, while the characteristic curve S3 represents the running speed pattern applied to the movable cage chamber by the cage chamber drive device. The characteristic curve S2 represents the speed changes in the movable cage chamber. In this case the speed change S2 of the movable cage chamber is the sum of the running speed pattern S3 applied to the movable cage chamber by the cage chamber drive device and the running speed pattern S1 of the hoist. Thus, the speed change pattern S2 of the movable cage chamber changes in a less regular manner than the normal running speed pattern of an elevator car.

If the distance between the two cage chambers of a double-deck elevator car is adjusted by operating the cage chamber drive device after the cage frame has stopped, as in FIG. 3, running time is prolonged, which is inconvenient and uncomfortable for the passengers. It is also problematic because it leads to decreased transport capacity.

If on the other hand the cage chamber drive device is operated in such a manner that the distance between the two cage chambers is adjusted while the cage frame is running, as in FIG. 4, the problem is that it imparts a feeling of strangeness and anxiety to the passengers because the movement of the movable cage chamber is different from that of an ordinary cage frame 1.

SUMMARY OF THE INVENTION

Accordingly, one object of the present invention is to provide a novel double-deck elevator car wherein it is possible to adjust the vertical distance between the cage chambers during operation in such a manner that the passengers do not sense any anxiety or discomfort.

With a view to attaining the above object, the present invention is a double-deck elevator car equipped with hoist for raising and lowering a cage frame on which are mounted two vertically arranged cage chambers, a hoist control device which controls the hoist and the speed of the cage frame, a cage chamber drive device which drives at least one of the vertically arranged cage chambers so as to alter the relative distance between the two cage chambers, and a cage chamber position control device which controls the cage chamber drive device, characterised in that the hoist control device controls the hoist in such a manner as to maintain a constant speed once the speed change of the cage frame has accelerated at a set rate of acceleration, then to decelerate at a set rate of deceleration and stop, and the cage chamber position control device controls the cage chamber drive device in such a manner as to allow the speed change of the cage chamber driven by the cage chamber drive device after the addition of the speed change of the cage frame to accelerate at a set rate of acceleration, to maintain a constant speed, then to decelerate at a set rate of deceleration and stop.

In the double-deck elevator car to which the present invention pertains, the hoist is controlled in such a manner as to maintain a constant speed once the speed change of the cage frame has accelerated at a set rate of acceleration, then to decelerate at a set rate of deceleration and stop. Meanwhile, the cage chamber drive device is controlled in such a manner as to allow the speed change of the cage chamber driven by the cage chamber position control device after the addition of the speed change of the cage frame to accelerate at a set rate of acceleration, to maintain a constant speed, then to decelerate at a set rate of deceleration and stop.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

With reference now to the drawings, wherein like codes denote identical or corresponding parts throughout the several views, and more particularly to FIG. 5 thereof, one embodiment of the present invention will be described.

Figure 1:
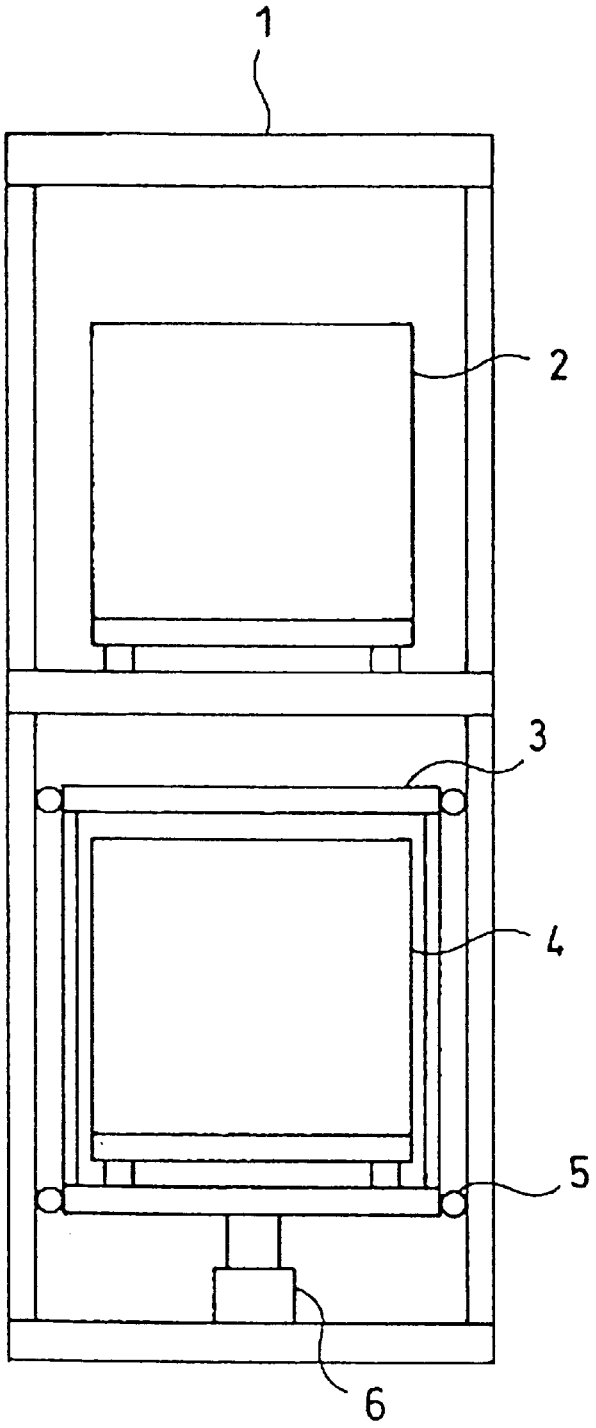
FIG. 1 ( PRIOR ART )
FIG. 1 is a block diagram illustrating an example of a double-deck elevator car wherein the distance between the cage chambers is variable.
Figure 2:
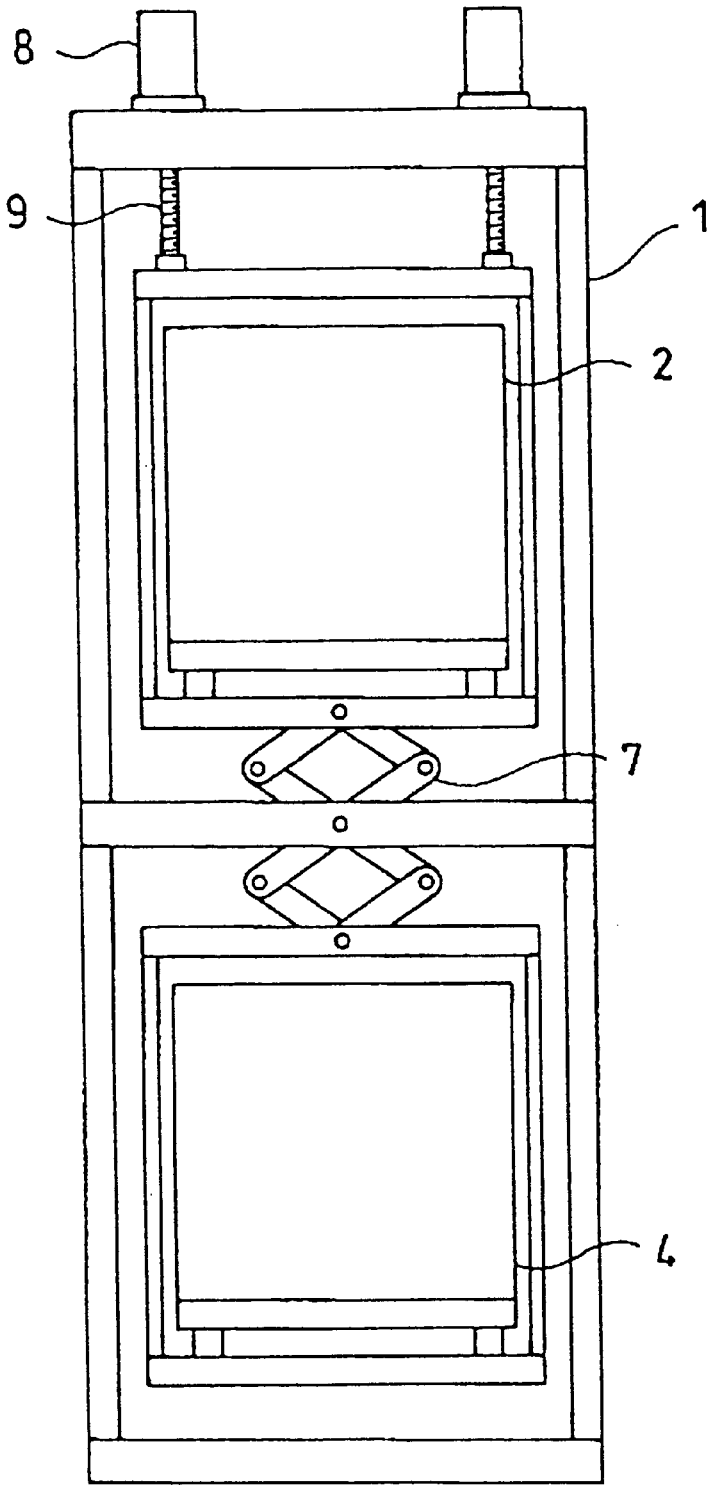
FIG. 2 ( PRIOR ART )
FIG. 2 is a block diagram illustrating another example of a double-deck elevator car wherein the distance between the cage chambers is variable.
Figure 3:
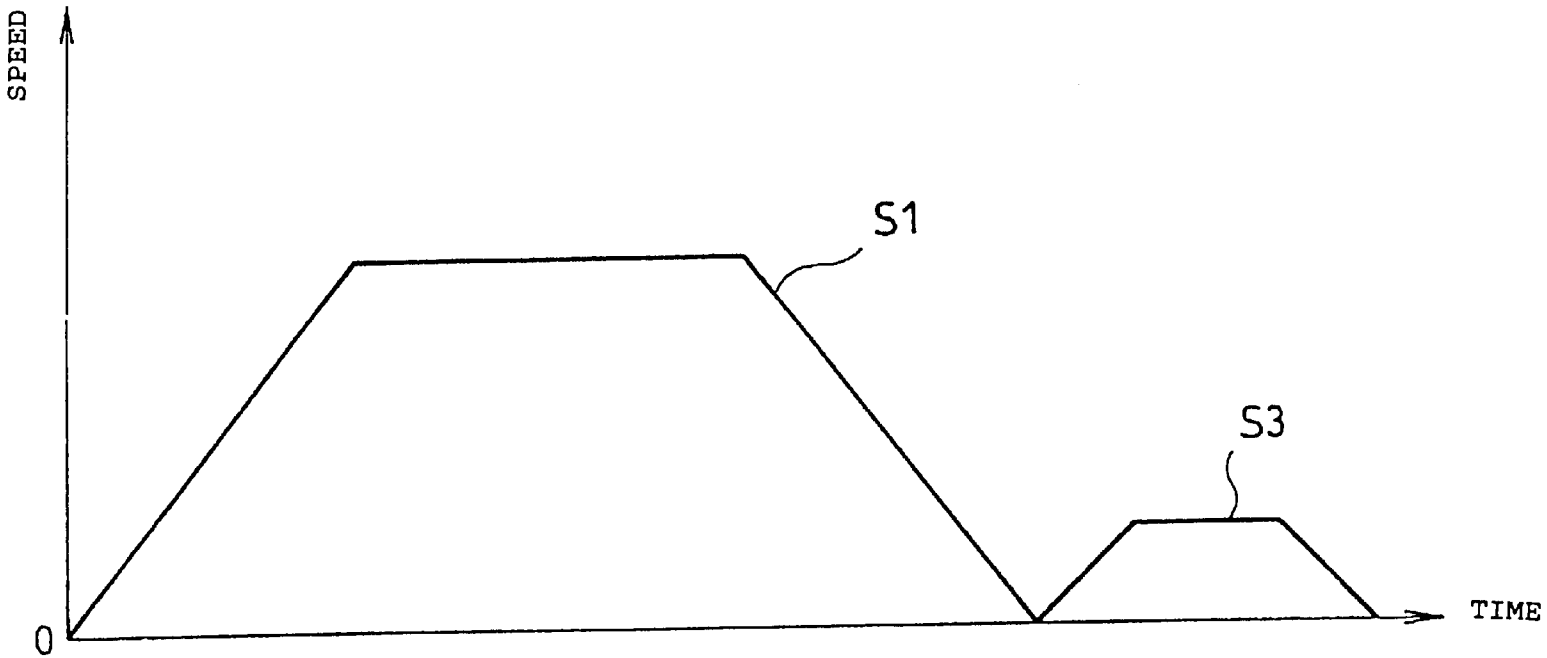
FIG. 3 ( PRIOR ART )
FIG. 3 illustrates a conventional characteristic speed pattern where the movable cage chamber is allowed to land by operating the cage chamber drive device after the double-deck elevator car stops.
Figure 4:
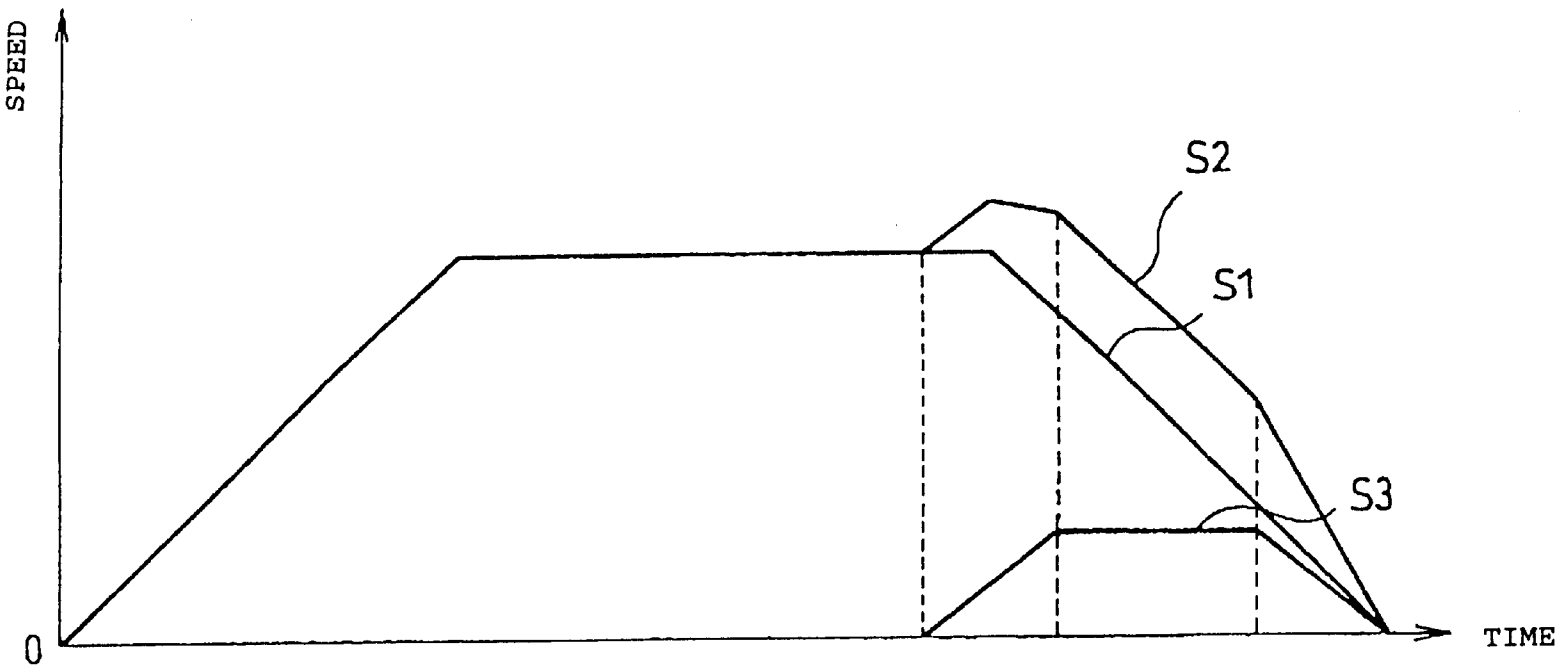
FIG. 4 ( PRIOR ART )
FIG. 4 illustrates a conventional characteristic speed pattern where the cage chamber drive device is operated during the running of a double-deck elevator car in order to allow a movable cage chamber to land at a floor.
Figure 5:
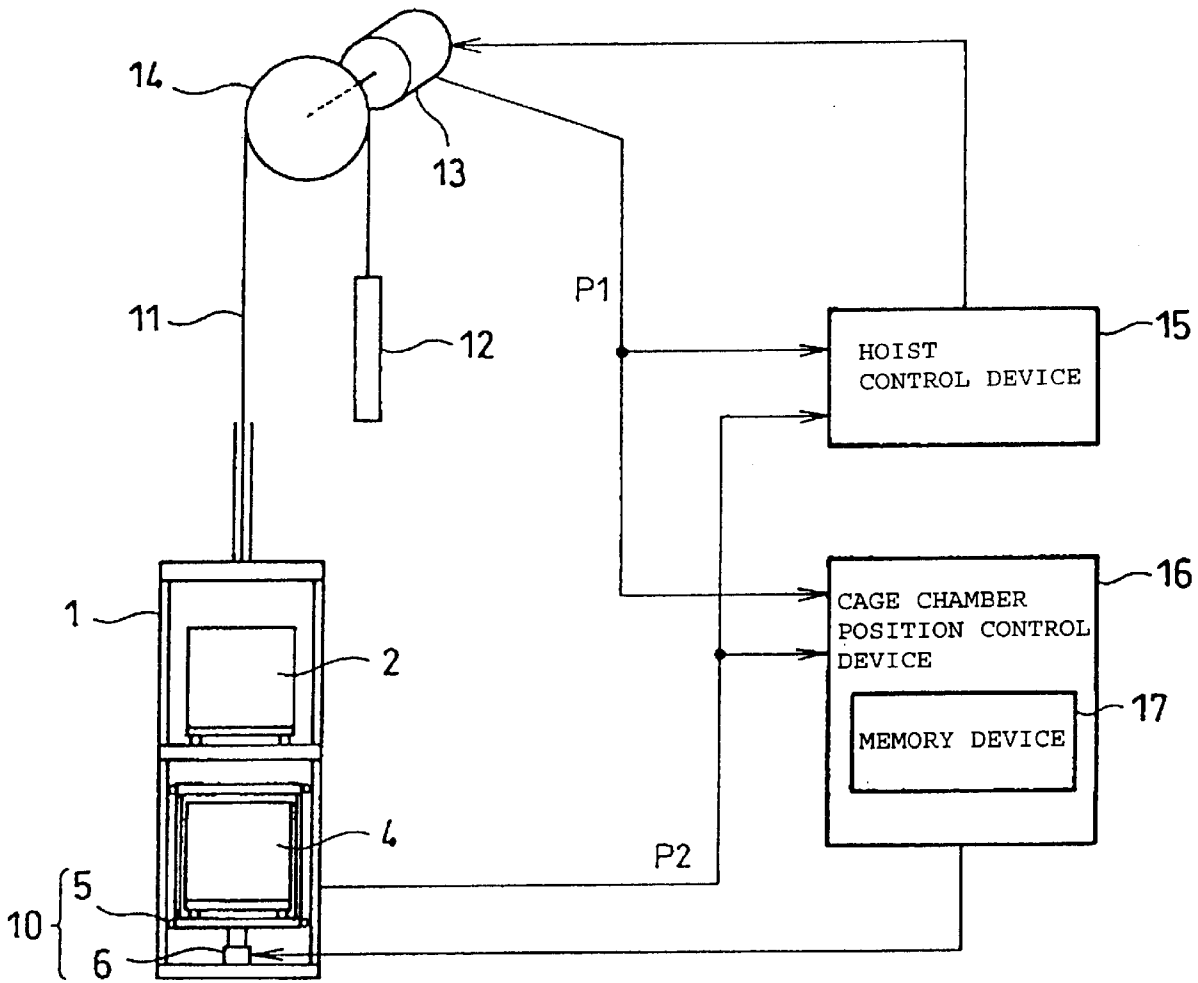
FIG. 5 is a block diagram of the double-deck elevator car to which the present invention pertains.

FIG. 5 is a block diagram of the double-deck elevator car to which the present invention pertains. In FIG. 5, an upper cage chamber 2 and a lower cage chamber 3 are mounted on a cage frame 1, and a cage chamber drive device 10 is fitted to either the upper cage chamber 2 or the lower cage chamber 3, or to both of them. In FIG. 5, a cage chamber drive device 4 is fitted to the lower cage chamber 3, and this cage chamber drive device 10 comprises a guide roller 5 and an actuator 6.

The cage frame 1 on which the upper cage chamber 2 and the lower cage chamber 3 are mounted is connected by way of a rope 11 to a counter-weight 12, and is driven up and down by the sheave 14 of the hoist 13. To this hoist is fitted, for instance, a pulse generator, proximity switch or similar cage position detector (not illustrated) for the purpose of detecting the position of the cage 1. When the position of the cage is detected, a cage position signal P1 is input to a hoist control device 15 and cage chamber position control device 16.

The cage chamber position control device 16 has a memory device 17, in which is stored data relating to the floor height dimensions of each story. Once the destination floors have been determined, the cage chamber position control device 16 calculates the distance between the two cage chambers in accordance with the floor height dimensions of the destination floors stored in advance in the memory device 17, and controls the cage chamber drive device 10.

Again, a cage position signal P2 from the movable cage chamber driven by the cage chamber drive device 10 is apparatus is detected by, for instance, a proximity switch or similar movable cage position detector (not shown), and input to the hoist control device 15 and cage chamber position control device 16.

The hoist control device 15 drives the hoist 13 and controls the speed of the cage frame 1 in accordance with the cage position signal P1 from the cage frame 1 and the cage position signal P2 from the movable cage chamber. Similarly, the cage chamber position control device 16 drives the cage chamber drive device 10 and controls the speed of the movable cage frame 1 in accordance with the cage position signal P1 from the cage frame 1 and the cage position signal P2 from the movable cage chamber.

In other words, in accordance with the cage position signal P1 from the cage frame 1 and the cage position signal P2 from the movable cage chamber, the hoist control device 15 controls the hoist in such a manner as to maintain a constant speed once the speed change of the cage frame 1 has accelerated at a set rate of acceleration, then to decelerate at a set rate of deceleration and stop. Meanwhile, the cage chamber position control device 16 controls the cage chamber drive device 10 in such a manner as to allow the speed change of the cage chamber driven by the cage chamber drive device after the addition of the speed change of the cage frame 1 to accelerate at a set rate of acceleration, to maintain a constant speed, then to decelerate at a set rate of deceleration and stop.

Figure 6:
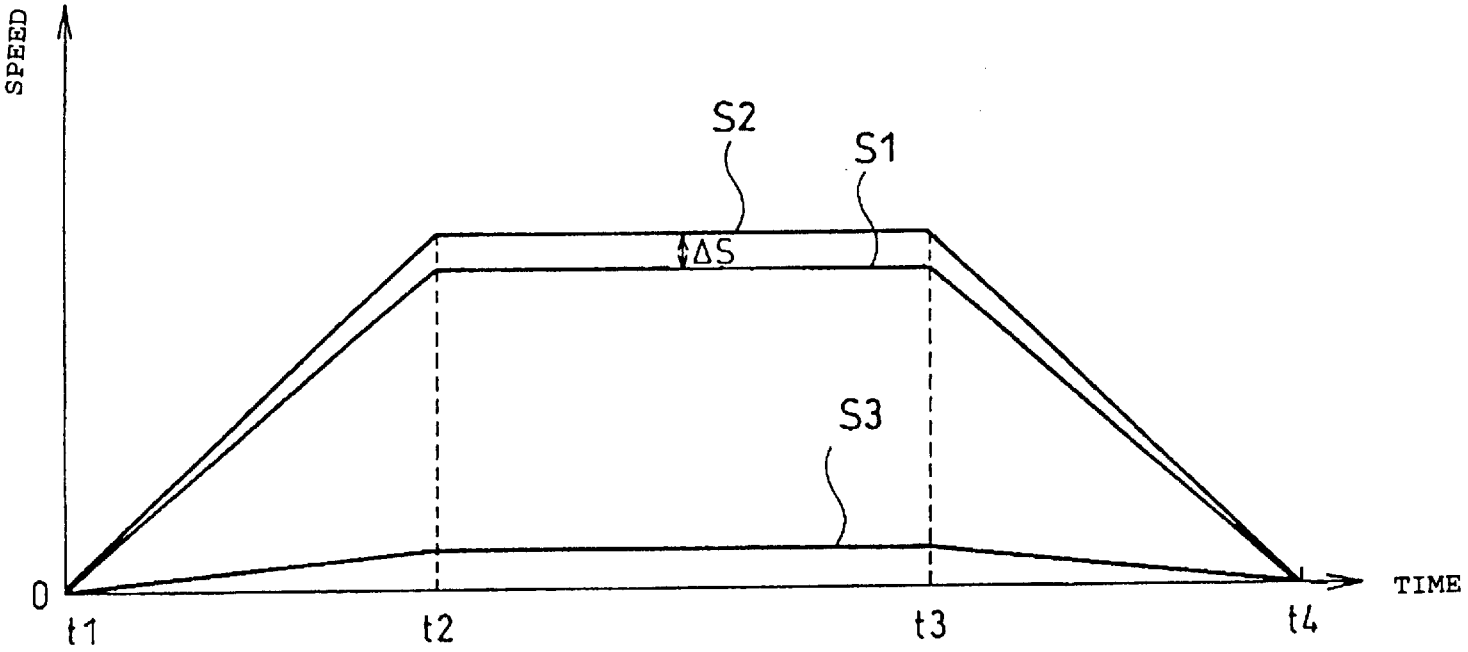
FIG. 6 illustrates characteristic speed changes of the cage frame and movable cage chamber of a double-deck elevator car in the first embodiment of the present invention.

FIG. 6 illustrates characteristic speed changes of the cage frame and movable cage chamber of a double-deck elevator car in the first embodiment of the present invention.

The first embodiment is a double-deck elevator car wherein only one of the cage chambers moves, and this is the speed pattern where the movable cage chamber is driven by the cage chamber drive device 10 in the direction of travel of the elevator car. The horizontal axis represents the speed, while the vertical axis represents time, and the drawing illustrates the running speed pattern S1 of the hoist 13 (speed change of the cage frame 1), speed change S2 of the movable cage chamber, and running speed pattern S3 of the cage chamber drive device 10.

As may be understood from the running speed pattern S1 of the hoist 13 and the running speed pattern S3 of the cage chamber drive device 10, the cage frame 1 and movable cage chamber both accelerate at a uniform acceleration from time-point t1 when they leave the departure floor to time-point t2, when they begin to run at constant speed. They then begin to decelerate simultaneously at time-point t3, doing so at a uniform deceleration to arrive and stop at the destination floor at time-point t4. The speed change S2 of the movable cage chamber driven by the cage chamber drive device 10 is the total of the running speed pattern S1 of the hoist 13 and the running speed pattern S3 of the cage chamber drive device 10. The speed which is generated in the movable cage chamber while running at constant speed is the rated speed of the double-deck elevator car. Consequently, the hoist 13 is driving the cage frame 1 at a speed which is less than the rated speed by the difference $\Delta S$ from the speed of the cage chamber drive device 10.

Meanwhile, the acceleration (from t1 to t2) and deceleration (from t3 to t4) generated in the movable cage chamber are the rated acceleration of this double-deck elevator car. Consequently, the hoist 13 is driving the cage frame 1 at an acceleration and deceleration which are less than those of a conventional elevator car by the acceleration and deceleration of the cage chamber drive device 10.

Controlling in this manner allows both cage chambers to assume a running pattern of uniform acceleration from start, followed by constant speed, uniform deceleration and stop, so that despite the operation of the cage chamber drive device 10 the passengers sense the same acceleration change as in the running of an ordinary elevator car, and their comfort is not impaired. Moreover, the acceleration of the hoist 13 is suppressed in order to ensure that the acceleration of the movable cage chamber, which is being driven by the cage chamber drive device 10, is equal to the rated acceleration of the double-deck elevator car. As a result, the acceleration generated even in the cage chamber driven by the cage chamber drive device 10 is no greater than normal, and the passengers do not sense the anxiety or fear which come from a high rate of acceleration.

Figure 7:
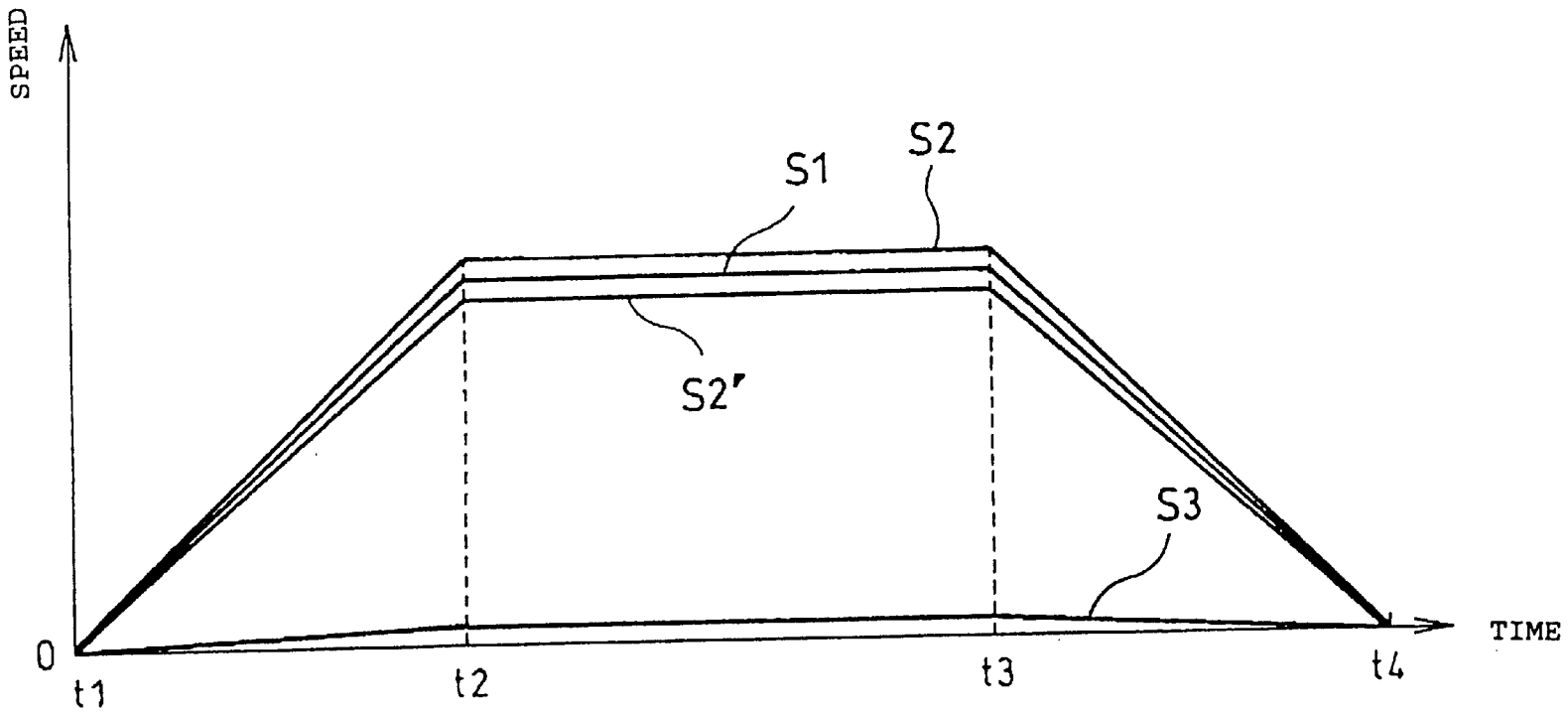
FIG. 7 illustrates characteristic speed changes of the cage frame and movable cage chamber of a double-deck elevator car in the second embodiment of the present invention.

FIG. 7 illustrates characteristic speed changes of the cage frame and movable cage chamber of a double-deck elevator car in a second embodiment of the present invention. This second embodiment illustrates the speed changes in a double-deck elevator car which is configured in such a manner that the cage chamber drive device 10 drives the two cage chambers simultaneously in mutually opposite directions.

In FIG. 7, the horizontal axis represents the speed, while the vertical axis represents time, and the drawing illustrates the running speed pattern S1 of the hoist 13 (speed change of the cage frame 1), speed change S2' of the movable cage chamber which is driven in the opposite direction to the direction of travel, and running speed pattern S3 of the cage chamber drive device 10.

As in the first embodiment, the cage frame 1 and movable cage chamber are driven by the hoist 13 and cage chamber drive device 10, both accelerating at a uniform acceleration from time-point t1 when they leave the departure floor to time-point t2, when they begin to run at constant speed. They begin to decelerate simultaneously at time-point t3, doing so at a uniform deceleration to arrive and stop at the destination floor at time-point t4.

The speed change S2 of the movable cage chamber driven by the cage chamber drive device 10 is the sum (total) of the running speed pattern S1 of the hoist 13 and the running speed pattern S3 of the cage chamber drive device 10. Moreover, the speed change S2' of the movable cage chamber, which is being driven by the cage chamber drive device 10 in the opposite direction to the direction of travel, is the difference between the speed pattern S1 of the hoist 13 and the running speed pattern S3 of the cage chamber drive device 10.

The acceleration and deceleration (from t1 to t2, and from t3 to t4) generated in the movable cage chamber, which is being driven in the opposite direction to the direction of travel of the elevator car are additional to the acceleration and deceleration generated in the cage frame 1, and are controlled in order to ensure that the total acceleration and deceleration are equal to the rated acceleration and deceleration of the elevator car, and that the constant speed (from t2 to t3) is also equal to the rated speed of the elevator car. Consequently, the hoist 13 drives the cage frame 1 at an acceleration (from t1 to t2), deceleration (from t3 to t4) and constant speed (from t2 to t3) which are less than the rated speed pattern of the elevator car by the acceleration and deceleration of the cage chamber drive device 10. This is controlled by the hoist control device 15 and cage chamber control device 16.

Controlling in this manner, as in the first embodiment, allows both cage chambers to assume a running pattern of uniform acceleration from start, followed by constant speed and uniform deceleration, so that despite the operation of the cage chamber drive device 10 the passengers sense the same acceleration change as in the running of an ordinary elevator car, and their comfort is not impaired. Moreover, the constant speed and acceleration generated in the movable cage chamber driven by the cage chamber drive device 10 in the direction of travel is controlled so as to be equal to the rated acceleration and constant speed of the elevator car, and thus the passengers do not sense the anxiety or fear which come from a high rate of acceleration.

Figure 8:
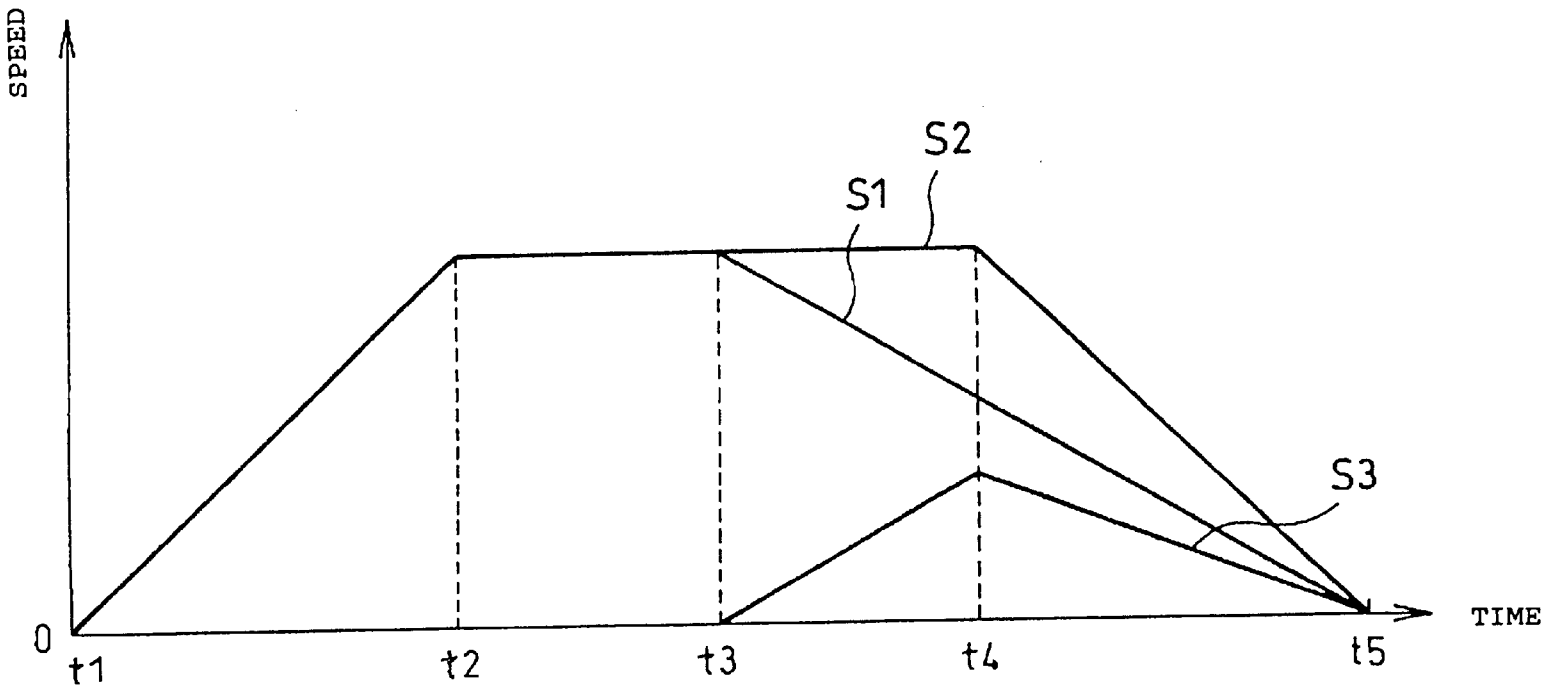
FIG. 8 illustrates characteristic speed changes of the cage frame and movable cage chamber of a double-deck elevator car in the third embodiment of the present invention.

FIG. 8 illustrates characteristic speed changes of the cage frame and movable cage chamber of a double-deck elevator car in the third embodiment of the present invention. This third embodiment illustrates the speed change pattern of a double-deck elevator car which is configured in such a manner that the cage chamber drive device 10 drives only one of the cage chambers, and does so in the direction of travel of the elevator car.

In FIG. 8, the horizontal axis represents the speed, while the vertical axis represents time, and the drawing illustrates the running speed pattern S1 of the hoist 13 (speed change of the cage frame 1), speed change S2 of the movable cage chamber, and running speed pattern S3 of the cage chamber drive device 10.

The cage frame 1 is driven by the hoist 13, and accelerates at the rated acceleration (from t1 to t2), when it begins to run at constant speed (from t2 to t3). The cage frame then begins to decelerate at a lower rate than the rated deceleration (from t3 to t4). At the same time, the cage chamber drive device 10 causes the movable cage chamber to begin accelerating (from t3 to t4) at a rate of the same magnitude as the one at which the hoist 13 causes the cage frame 1 to decelerate. Accordingly, the speed pattern S2 of the movable cage chamber remains unchanged from t3 to t4. In other words, it is maintained at the same magnitude as the rated speed of the elevator car.

At time-point t4 the cage chamber drive device 10 begins to decelerate at a uniform deceleration (from t4 to t5), at which time the combined deceleration of the cage frame 1 and the cage chamber are controlled in such a manner as to be of the same magnitude as the rated deceleration of the elevator car. That is to say, the deceleration of the movable cage chamber between time points t4 and t5 of the speed change S2 is controlled in such a manner as to be of the same magnitude as the rated deceleration of the elevator car.

Controlling in this manner allows both cage chambers to assume a running pattern where, in spite of the difference in the timing of constant speed running, both accelerate uniformly, run at constant speed, decelerate uniformly and stop. As a result, the passengers do not sense anything unusual from the operation of the cage chamber drive device 10. Moreover, the constant speed and acceleration generated in both the movable cage chambers do not exceed the rated acceleration and constant speed of the elevator car, and thus the passengers do not sense the anxiety or fear which come from a high rate of acceleration.

What is more, adjustment of the distance between the cage chambers by the cage chamber drive device 10 is implemented while the cage frame is moving at constant speed. Thus, it is possible to provide a smoother service than with the first and second embodiments with no impairment of comfort even if a call is received during running from an intermediate floor where the floor height is different, because the cage chamber drive device 10 can be controlled to match the dimensions between floors before landing at that floor.

Figure 9:
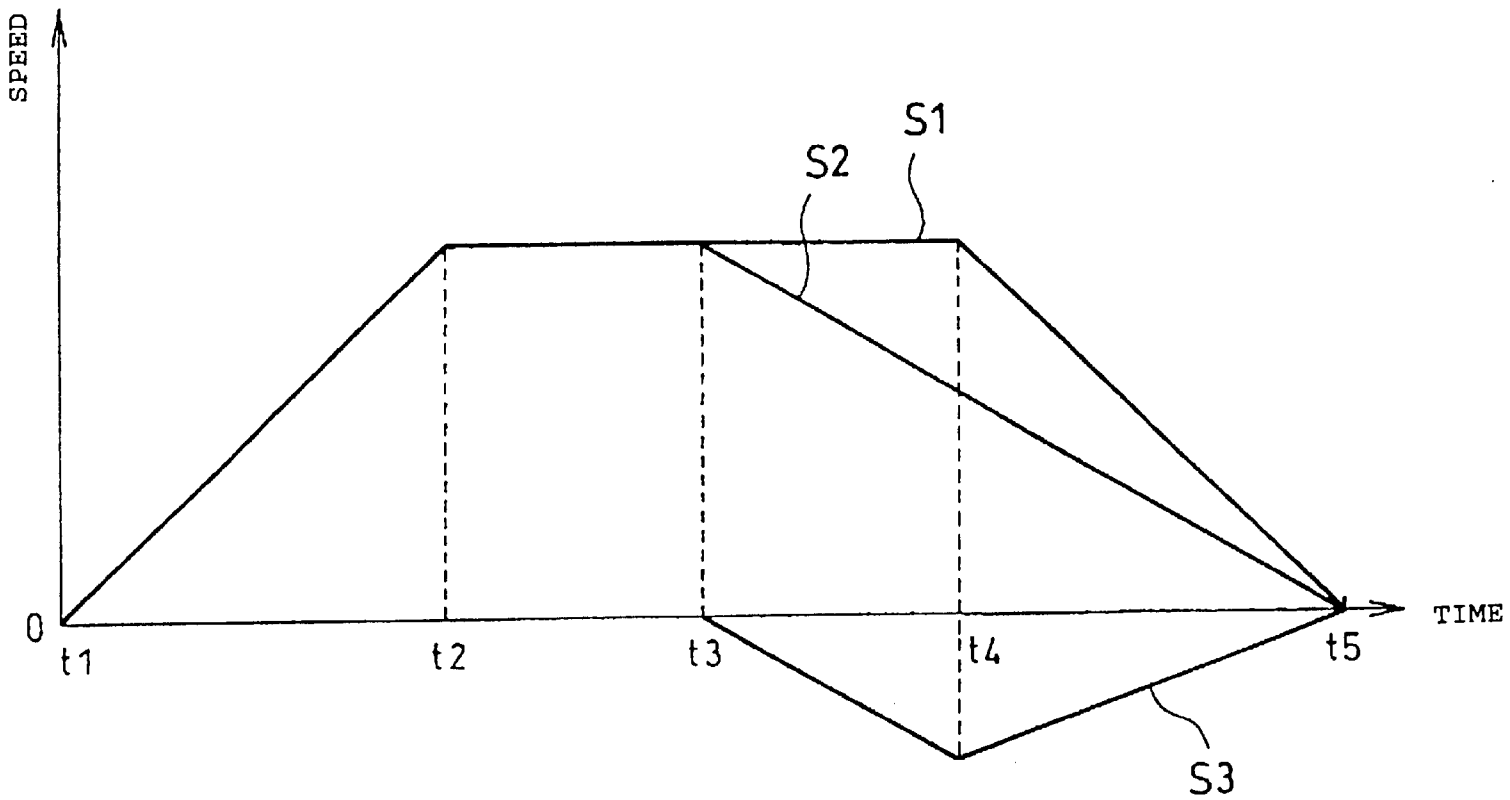
FIG. 9 illustrates characteristic speed changes of the cage frame and movable cage chamber of a double-deck elevator car in the fourth embodiment of the present invention.

FIG. 9 illustrates characteristic speed changes of the cage frame and movable cage chamber of a double-deck elevator car in a fourth embodiment of the present invention.

This fourth embodiment illustrates the speed change pattern of a double-deck elevator car which is configured in such a manner that the cage chamber drive device 10 drives only one of the cage chambers, and does so in the opposite direction to the direction of travel of the elevator car.

In FIG. 9, the horizontal axis represents the speed, while the vertical axis represents time, and the drawing illustrates the running speed pattern S1 of the hoist 13 (speed change of the cage frame 1), speed change S2 of the movable cage chamber, and running speed pattern S3 of the cage chamber drive device 10.

As the running speed pattern S1 shows, the cage frame 1 is driven by the hoist 13, and accelerates at the rated acceleration (from t1 to t2), when it begins to run at constant speed (from t2 to t4). At time-point t3, while the cage frame 1 is running at constant speed, the cage chamber drive device 10 causes the movable cage chamber to begin accelerating, as may be seen from running speed pattern S3. At time-point t4, when the cage frame 1 begins to decelerate, the cage chamber drive device 10 causes the movable cage chamber to switch from acceleration to deceleration (from t4 to t5). In this case, the change which the cage chamber drive device 10 causes to the acceleration of the movable cage chamber is controlled in such a manner as to be equal to that which the hoist 13 causes in the deceleration of the cage frame 1, thus ensuring that no change occurs in the acceleration of the movable cage chamber at time-point t4. The deceleration of the cage frame 1 is the rated deceleration of travel of the elevator car.

Controlling in this manner allows both cage chambers to assume running patterns S1 and S2 where, in spite of the difference in the timing of constant speed running, both accelerate uniformly, run at constant speed, decelerate uniformly and stop. As a result, the passengers do not sense anything unusual from the operation of the cage chamber drive device 10. Moreover, the constant speed and acceleration generated in both the movable cage chambers do not exceed the rated acceleration, rated deceleration and constant speed of the elevator car, and thus the passengers do not sense the anxiety or fear which come from a high rate of acceleration or deceleration.

What is more, as in the case of the third embodiment, adjustment of the distance between the cage chambers by the cage chamber drive device 10 is implemented while the cage frame is moving at constant speed. Thus, it is possible to provide a smoother service than with the first and second embodiments with no impairment of comfort even if a call is received during running from an intermediate floor where the floor height is different, because the cage chamber drive device 10 can be controlled to match the dimensions between floors before landing at that floor.

Figure 10:
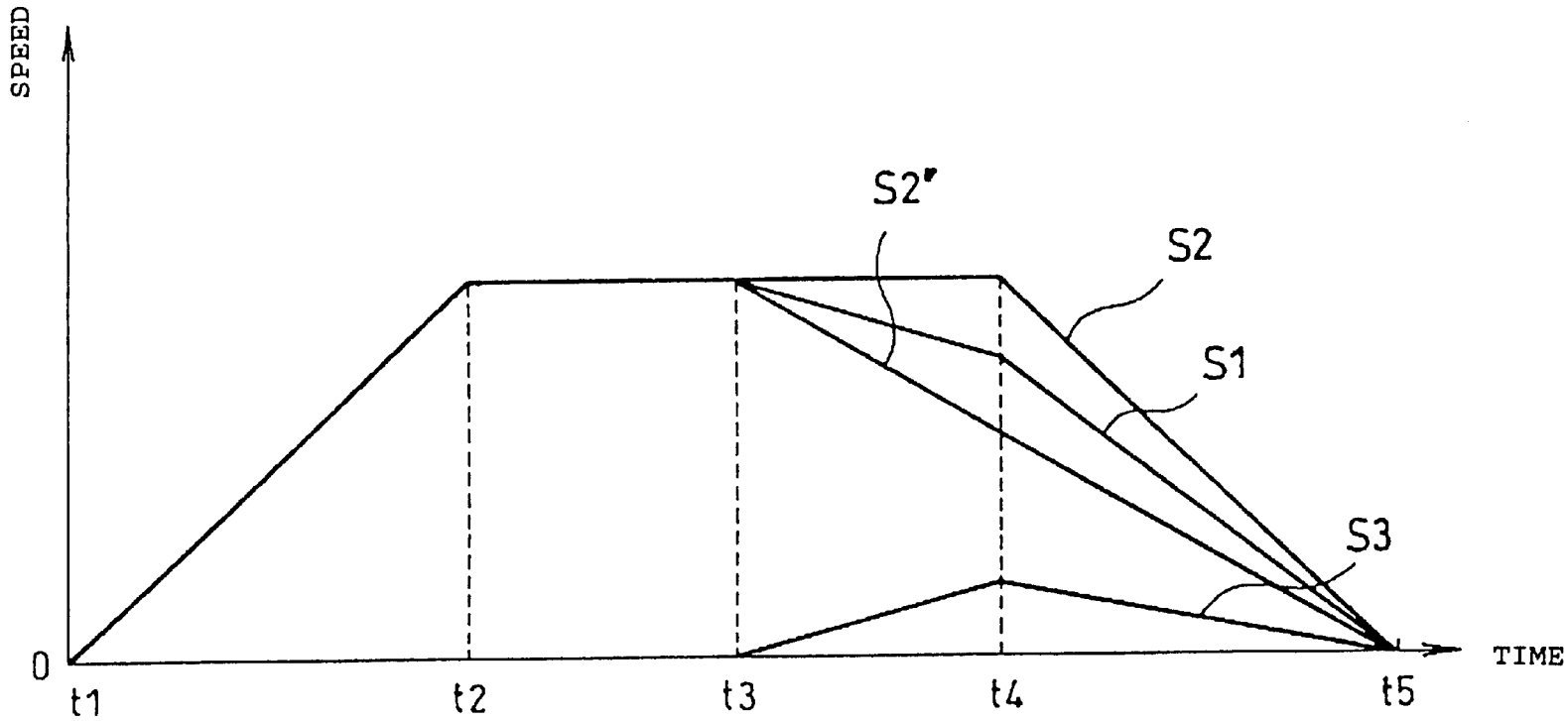
FIG. 10 illustrates characteristic speed changes of the cage frame and movable cage chamber of a double-deck elevator car in the fifth embodiment of the present invention.

FIG. 10 illustrates characteristic speed changes of the cage frame and movable cage chamber of a double-deck elevator car in the fifth embodiment of the present invention. This fifth embodiment illustrates the speed change pattern of a double-deck elevator car which is configured in such a manner that the cage chamber drive device 10 drives both the cage chambers simultaneously in opposite directions.

In FIG. 10, the horizontal axis represents the speed, while the vertical axis represents time, and the drawing illustrates the running speed pattern S1 of the hoist 13 (speed change of the cage frame 1), speed change S2 of the movable cage chamber which is driven in the direction of travel of the elevator car, speed change S2' of the movable cage chamber which is driven in the opposite direction to the direction of travel of the elevator car, and running speed pattern S3 of the cage chamber drive device 10.

As the running speed pattern S1 shows, the cage frame 1 is driven by the hoist 13, and accelerates at the rated acceleration (from t1 to t2), when it begins to run at the rated constant speed (from t2 to t3). At time-point t3, while the cage frame 1 is running at the rated constant speed, the cage chamber drive device 10 causes the cage chambers to begin accelerating, as may be seen from running speed pattern S3. Accordingly, the speed change S2' of the movable cage chamber which is driven in the opposite direction to the direction of travel of the elevator car begins to decelerate, while the speed pattern S2 of the movable cage chamber which is driven in the direction of travel of the elevator car maintains constant speed with the addition of the running speed of the movable cage chamber to that of the cage frame.

At time-point t4 the running speed pattern S3 of the cage chamber drive device 10 switches from acceleration to deceleration, and the running speed pattern S1 of the hoist 13 increases the rate of deceleration. In this case, the change which the cage chamber drive device 10 causes to the acceleration of the movable cage chamber is controlled in such a manner as to be equal to that which the hoist 13 causes in the deceleration of the cage frame 1, thus ensuring that no change occurs in the acceleration of the movable cage chamber which is being driven by the cage chamber drive device 10 in the opposite direction to the direction of travel of the elevator car. Moreover, the deceleration of the cage frame 1 is less than the rated deceleration of the elevator car by the amount of deceleration of the cage chamber drive device 10. Consequently, the deceleration of the speed change S2' of the movable cage chamber which is being driven in the opposite direction to the direction of travel of the elevator car remains constant, while the speed change S2 of the movable cage chamber which is being driven in the direction of travel of the elevator car decelerates with the addition of the deceleration due to the cage chamber drive device 10 to that due to the hoist 13. The deceleration in this case is the rated deceleration of the elevator car.

Controlling in this manner allows both cage chambers to assume running patterns S2 and S2' where both accelerate uniformly, run at constant speed, decelerate uniformly and stop. As a result, the passengers do not sense anything unusual from the operation of the cage chamber drive device 10. Moreover, the constant speed, acceleration and deceleration generated in both the movable cage chambers do not exceed the rated acceleration, deceleration and constant speed of the elevator car, and thus the passengers do not sense the anxiety or fear which come from a high rate of acceleration or deceleration.

What is more, as in the case of the third and fourth embodiments, adjustment of the distance between the cage chambers by the cage chamber drive device 10 is implemented while the cage frame is moving at constant speed. Thus, it is possible to provide a smoother service than with the first and second embodiments with no impairment of comfort even if a call is received during running from an intermediate floor where the floor height is different, because the cage chamber drive device 10 can be controlled to match the dimensions between floors before landing at that floor. It should be added that in each of the above embodiments there is no impairment of comfort even if the time-points of the changes in the pattern of acceleration from start, constant speed, deceleration and stopping diverge slightly between the cage frame 1 and the movable cage chamber.

Figure 12:
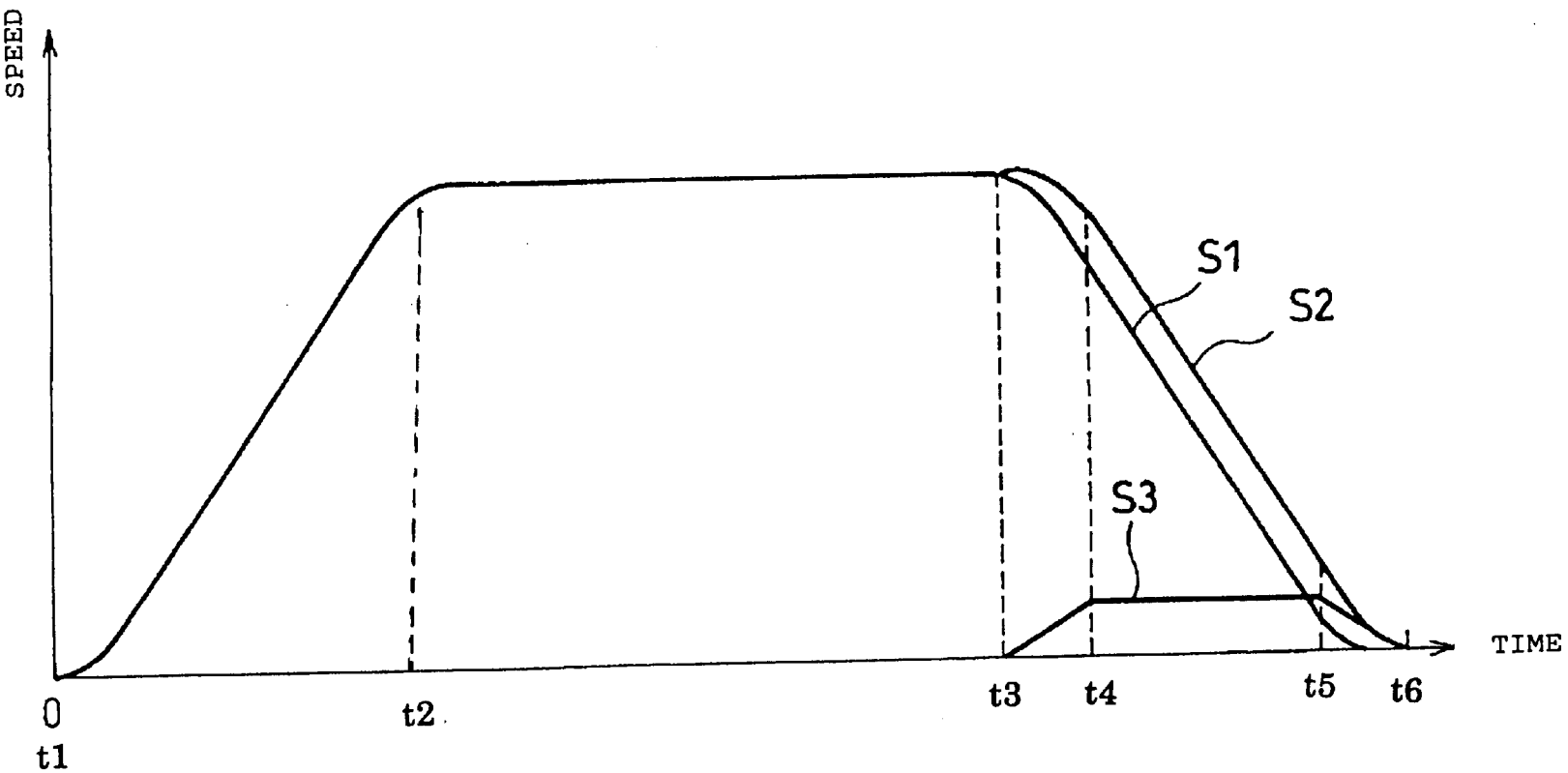
FIG. 12 illustrates characteristic speed changes of the cage frame and movable cage chamber of a double-deck elevator car in the seventh embodiment of the present invention.

FIG. 12 illustrates characteristic speed changes of the cage frame and movable cage chamber of a double-deck elevator car in the sixth embodiment of the present invention. This sixth embodiment differs from the first embodiment as illustrated in FIG. 6 in that it adds a jerk where the acceleration of the cage frame 1 due to the hoist 13 and that of the movable cage chamber due to the cage chamber drive device 10 change.

Figure 11:
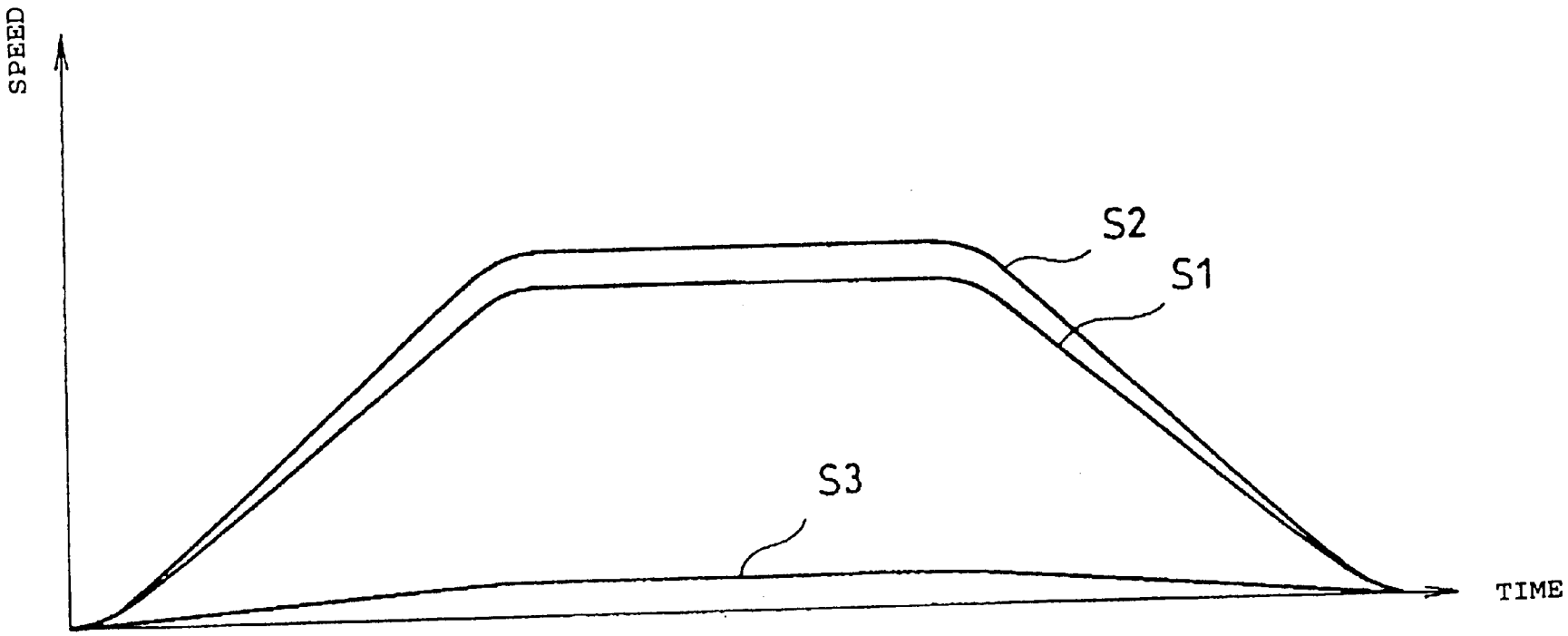
FIG. 11 illustrates characteristic speed changes of the cage frame and movable cage chamber of a double-deck elevator car in the sixth embodiment of the present invention.

In FIG. 11, the horizontal axis represents the speed, while the vertical axis represents time, and the drawing illustrates the running speed pattern S1 of the hoist 13 (speed change of the cage frame 1), speed change S2 of the movable cage chamber which is driven in the direction of travel of the elevator car, and running speed pattern S3 of the cage chamber drive device 10. It goes without saying that this may also be applied to the second embodiment to the fifth embodiment as illustrated in FIGS. 7 to 10.

This serves to eliminate momentary acceleration changes, rendering speed changes smoother and affording passengers a more comfortable ride. The addition of a jerk in this manner allows passengers within the cage chamber to remain almost completely unaware of any deterioration in comfort even if speed changes are not effected entirely in accordance with the control commands and are somewhat out of phase.

FIG. 12 illustrates characteristic speed changes of the cage frame and movable cage chamber of a double-deck elevator car in the seventh embodiment of the present invention. This seventh embodiment illustrates the speed change pattern of a double-deck elevator car which is configured in such a manner that the cage chamber drive device 10 drives one of the two cage chambers in the direction of travel of the elevator car.

The horizontal axis represents the speed, while the vertical axis represents time, and the drawing illustrates the running speed pattern S1 of the hoist 13 (speed change of the cage frame 1), speed change S2 of the movable cage chamber, and running speed pattern S3 of the cage chamber drive device 10.

As may be understood from the running speed pattern S3, the cage chamber drive device 10 finishes accelerating between time-point t3 when the hoist 13 starts to decelerate, and time-point t4 when it attains uniform deceleration. The movable cage chamber is driven at a constant speed until time-point t5 when the hoist 13 begins to reduce its deceleration. Moreover, it finishes decelerating by time-point t4 when the hoist 13 stops. The distance between the two cage chambers is adjusted and they stop slightly before or substantially at the same time as the hoist 13 stops.

In other words, the cage chamber position control device 16 controls the cage chamber drive device 10 in such a manner that it begins to operate at substantially the same time as the hoist switches from constant speed to deceleration, and alters the distance between the two cage chambers at uniform speed while the hoist 13 is driving the cage frame 1 at a uniform deceleration prior to stopping (from t4 to t5).

In this case, the hoist control device 15 and cage chamber position control device 16 control both the cage chambers so as to decelerate in the manner represented by the speed changes S1 and S2. The cage chamber drive device 10 is made to cease operating at substantially the same time as the hoist stops.

Moreover, the hoist control device 15 calculates the deceleration times from t3 to t4, from t4 to t5 and from t5 to t6 required to stop at each floor, and transmits this data to the cage chamber position control device 16. The cage chamber position control device 16 calculates the acceleration, deceleration and other information required to move the cage chamber drive device 10 on the basis of time data from the hoist control device 15 and data on the distance between floors at the destination floor which is stored in the memory device 17. In this manner the cage chamber drive device is controlled so that the movable cage chambers finish moving when the hoist stops.

No precise description of the working of the memory device 17 has been given with respect to the first embodiment to the sixth embodiment, but it is the same as in this embodiment.

Controlling in this manner allows the fixed cage chamber to assume the same running pattern as an ordinary elevator car.

As a result it goes without saying that the passengers do not sense anything unusual about the adjustment of the distance between the cage chambers. Even in the movable cage the passengers scarcely sense anything unusual and there is no impairment of comfort because all they feel is constant speed followed by acceleration (from t3 to t4), then deceleration at a constant rate (from t4 to t5) and stop (from t5 to t6), which is the same running speed pattern as with an ordinary elevator car.

What is more, because the cage chamber drive device 10 starts to operate as soon as a stopping floor is nominated and the hoist begins to decelerate, there is no need to alter the speed of the cage chamber drive device 10 in response to intermediate calls.

Figure 13:
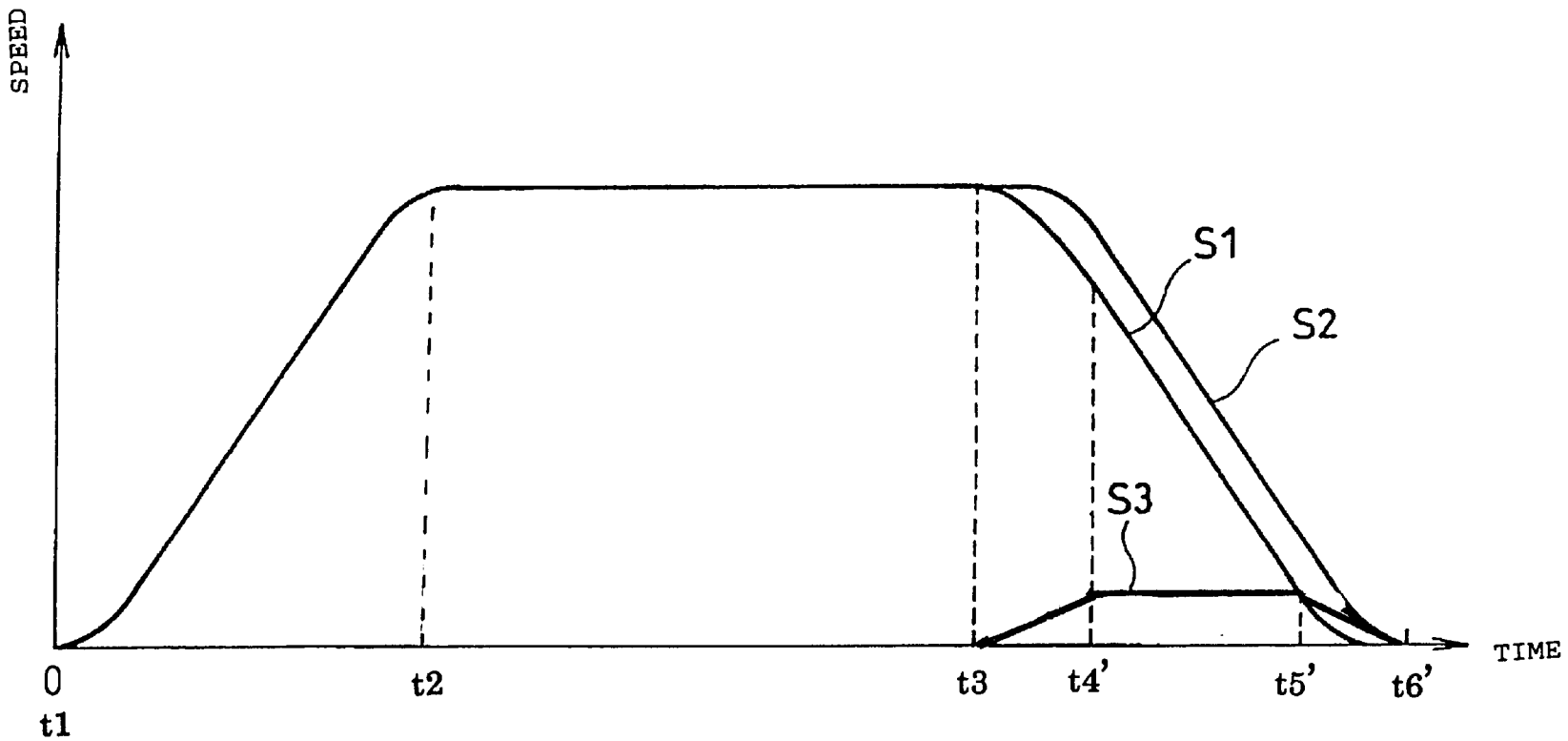
FIG. 13 illustrates characteristic modified speed changes of the cage frame and movable cage chamber of a double-deck elevator car in the seventh embodiment of the present invention.

FIG. 13 illustrates modified characteristic speed changes of the cage frame and movable cage chamber of a double-deck elevator car in the seventh embodiment of the present invention. In this modification, acceleration time (from t3 to t4', and from t5' to t6') is prolonged in comparison with the example illustrated in FIG. 12. This is achieved by allowing the hoist control device 15 to exert less control than normal on the rate of acceleration when the hoist switches from constant speed to deceleration. This means that the rate of acceleration of the moving cage chamber is lower than in the example illustrated in FIG. 12, so that the passengers sense even less unusual in the action of adjusting the distance between the cage chambers.

Figure 14:
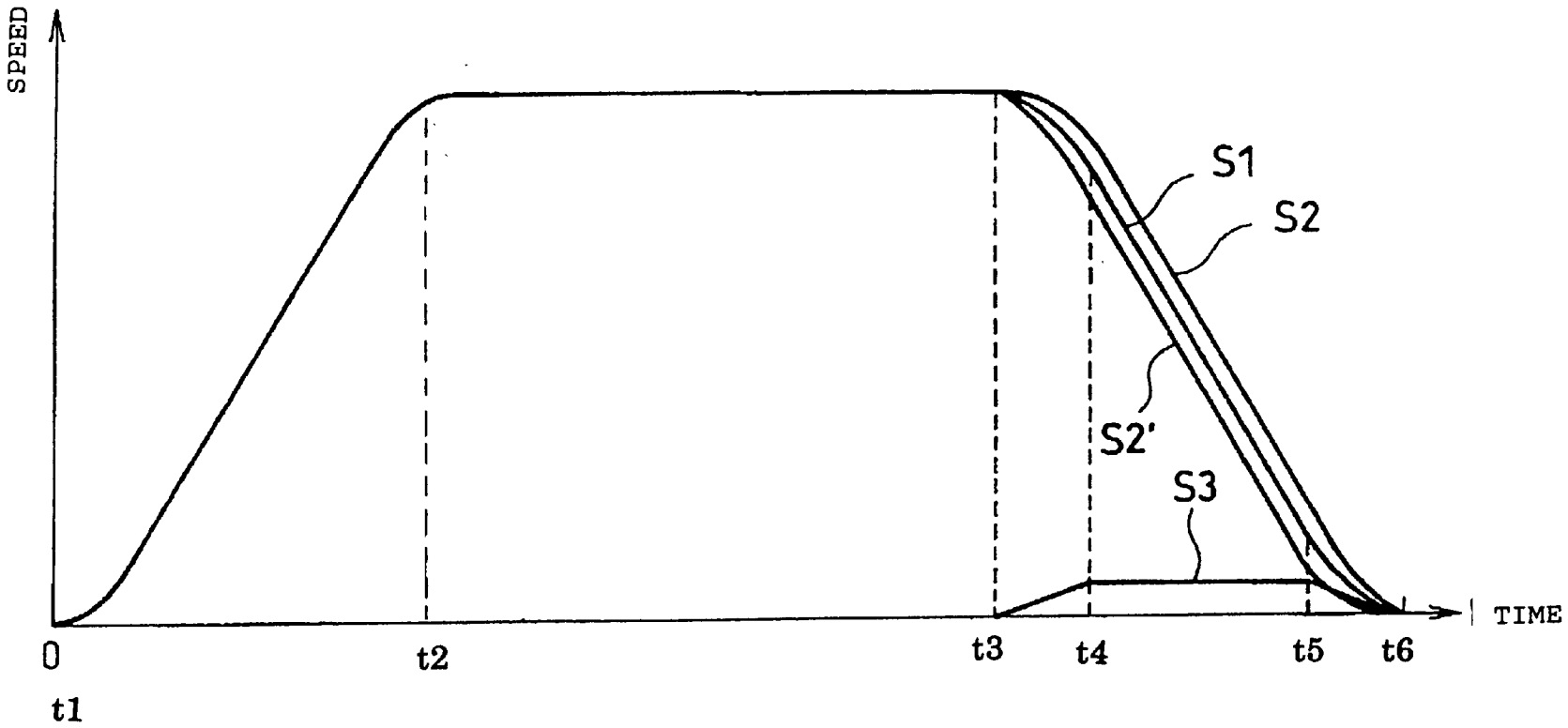
FIG. 14 illustrates another characteristic modified speed changes of the cage frame and movable cage chamber of a double-deck elevator car in a seventh embodiment of the present invention.

FIG. 14 illustrates other modified characteristic speed changes of the cage frame and movable cage chamber of a double-deck elevator car in a seventh embodiment of the present invention. This example shows speed changes in a double-deck elevator car which is configured in such a manner that the cage chamber drive device 10 drives the two cage chambers simultaneously in mutually opposite directions.

In FIG. 14, the horizontal axis represents the speed, while the vertical axis represents time, and the drawing illustrates the running speed pattern S1 of the hoist 13 (speed change of the cage frame 1), speed change S2 of the movable cage chamber which is driven in the direction of travel of the elevator car, speed change S2' of the movable cage chamber which is driven in the opposite direction to the direction of travel of the elevator car, and running speed pattern S3 of the cage chamber drive device 10.

As in the example illustrated in FIG. 12, the hoist 13 causes the cage frame 1 to accelerate at a fixed acceleration after leaving the departure floor, then to switch to constant speed, and decelerate at time-point t3. It is controlled in such a manner that it decelerates thereafter at a fixed deceleration from time-point t4 when it attains the rated deceleration to time-point t5 when the deceleration begins to decrease, continuing to do so from time-point t5 until it stops at time-point t6.

The speed change S2 of the movable cage chamber driven by the cage chamber drive device 10 in the direction of travel is the sum of the running speed pattern S1 of the hoist 13 and the running speed pattern S3 of the cage chamber drive device 10. Meanwhile, the speed change S2' of the movable cage chamber driven by the cage chamber drive device 10 in the opposite direction to the direction of travel is the difference between the running speed pattern S1 of the hoist 13 and the running speed pattern S3 of the cage chamber drive device 10.

As may be understood from the running speed pattern S3, the cage chamber drive device 10 finishes accelerating between time-point t3 when the hoist 13 starts to decelerate, and time-point t4 when it attains uniform deceleration. The movable cage chamber is driven at a constant speed until time-point t5 when the hoist 13 begins to reduce its deceleration. Moreover, the cage chamber drive device 10 finishes decelerating by time-point t6 when the hoist 13 stops. The distance between the two cage chambers is adjusted and they stop slightly before or substantially at the same time as the hoist 13 stops.

Controlling in this manner, as in the case of the example illustrated in FIG. 12, allows the fixed cage chamber to assume the same running pattern as an ordinary elevator car, which is to say in both cage chambers constant speed followed by acceleration (from t3 to t4), then deceleration at a constant rate (from t4 to t5) and stop (from t5 to t6). As a result, the passengers scarcely sense anything unusual and there is no impairment of comfort.

What is more, because the cage chamber drive device 10 starts to operate as soon as a stopping floor is nominated and the hoist 13 begins to decelerate, there is no need to alter the speed of the cage chamber drive device 10 in response to intermediate calls.

Figure 15:
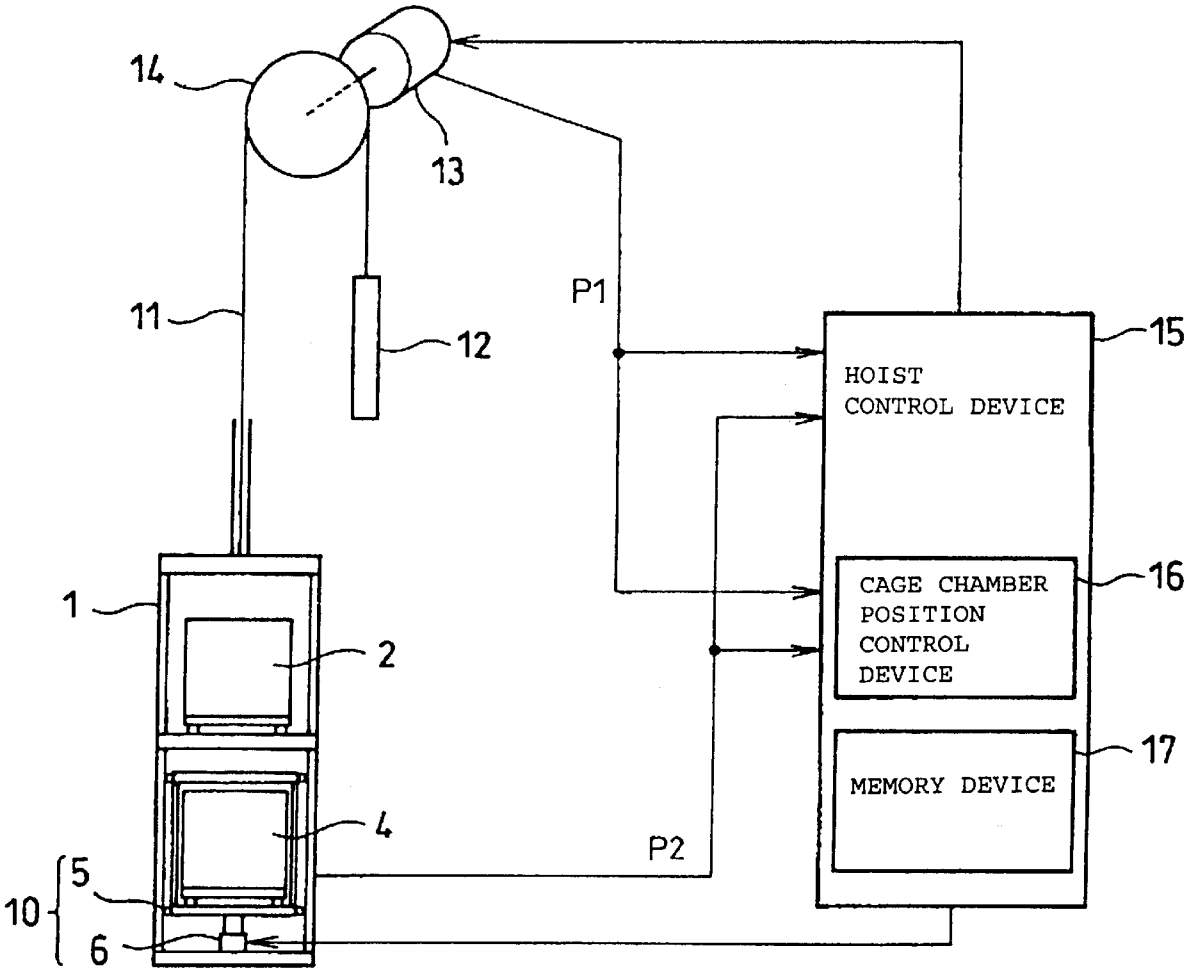
FIG. 15 is a block diagram illustrating an example of a double-deck elevator car in the eighth embodiment of the present invention.

There follows a description of the eighth embodiment of the present invention. FIG. 15 is a block diagram of a double-deck elevator car in the eighth embodiment of the present invention. This eighth embodiment differs from the first embodiment illustrated in FIG. 5 in that the cage chamber position control device 16 and memory device 17 are housed within the hoist control device 15.

The hoist control device 15 houses the cage chamber position control device 16 and memory device 17, and the configuration is such that control commands for the hoist 13 and for the cage chamber drive device 10 are issued simultaneously from the hoist control device 15.

In this configuration, the fact that the control commands are issued to the cage chamber drive device 10 by means of a tail cord (not illustrated) from a hoist control device 15 housed in the elevator car machine room means that a large number of cables are required, but concentrating them in one control device makes for simplicity in the transmission of data between control devices and allows cost savings to be made.

As has been explained above, the present invention controls a double-deck elevator car by adjusting the distance between the two cage chambers so that irrespective of status of action to implement distance correction and stop status between cage chambers and it is able to run according to a speed pattern whereby it accelerates at a fixed acceleration, maintains a constant speed, and then decelerates at a fixed deceleration. This allows passengers to feel as if they were riding in an ordinary elevator car.

With the present invention, the running speed patterns of both the upper and lower cage chambers are such that they accelerate at a fixed acceleration, maintain a constant speed, and then decelerate at a fixed deceleration irrespective of the action of the cage chamber drive device and stop. Moreover, even if intermediate calls mean that the elevator car stops at destination floors with different floor heights, passengers do not sense anything strange about the running of the cage chamber drive device, and are able to feel as if they were riding in an ordinary elevator car.

Obviously, numerous additional modifications and variations of the present invention are possible in the light of the above teachings. It is therefore to be understood that within the scope of the appended claims the present invention may be practiced otherwise than as specifically described herein.

What is claimed is:

1. A double-deck elevator car, comprising:

a hoist configured to raise and lower a cage frame on which are mounted two vertically arranged cage chambers;

a hoist control device configured to control said hoist and a speed of raising and lowering of said cage frame to cause the cage frame to accelerate at a set rate of acceleration, to then maintain a constant speed, and to then decelerate at a set rate of deceleration to a stop;

a cage chamber drive device configured to drive at least one of the vertically arranged cage chambers so as to alter the relative distance between said two cage chambers; and a cage chamber position control device configured to control said cage chamber drive device to cause the relative distance between said two cage chambers to change during movement of said cage frame by the hoist controlled by the hoist control device so as to produce a combined movement by the hoist and the cage chamber drive device like a movement of a standard elevator car with a set rate of acceleration followed by movement at a constant speed and a set rate of deceleration to a stop at a selected floor.

2. The double-deck elevator car according to claim 1, wherein said cage chamber drive device is configured to drive only one of the two cage chambers, the other cage chamber being fixed to said cage frame.

3. The double-deck elevator car according to claim 1, wherein said cage chamber drive device is configured to drive both said cage chambers in mutually opposite directions.

4. The double-deck elevator car according to claim 1, and further comprising:

a memory device configured to store predetermined data relating to floor height dimensions for each story of a building, wherein said cage chamber position control device is further configured to calculate a vertical distance between said two cage chambers and to control said cage chamber drive device in accordance with said floor height dimensions of destination floors stored in said memory device once said destination floors have been determined.

5. The double-deck elevator car according to claim 2 or claim 3, wherein if a relative vertical distance between said cage chambers at said departure floors and at said destination floors is to be altered, said cage chamber position control device is further configured to control said cage chamber drive device in such a manner that a timing of a start and finish of acceleration and of a start and finish of deceleration of said cage chamber according to said cage chamber drive device are substantially the same as a timing of a start and finish of acceleration and of a start and finish of deceleration of said cage chamber according to said hoist.

6. The double-deck elevator car according to claim 5, wherein said hoist control device is further configured to control said hoist in such a manner that when said cage chamber drive device operates so as to cause said cage chambers to accelerate or decelerate, said acceleration or deceleration generated in said cage chambers by said hoist is equal to or less than a rated acceleration or deceleration of said standard elevator car.

7. The double-deck elevator car according to claim 6, wherein said hoist control device is further configured to control said hoist in such a manner that a sum of an acceleration or deceleration of said cage frame and an acceleration or deceleration of said cage chambers is substantially equal to said rated acceleration or deceleration of said standard elevator car.

8. The double-deck elevator car according to claim 2, wherein said cage chamber position control device is further configured to control said cage chamber drive device in such a manner that if a cage chamber is to be driven in the same direction as that in which said cage frame is being driven by said hoist, said cage chamber position control device accelerates as soon as said cage frame begins to decelerate, begins to decelerate as soon as acceleration finishes, and finishes decelerating at the same time as said cage frame does.

9. The double-deck elevator car according to claim 2, wherein said cage chamber position control device is further configured to control said cage chamber drive device in such a manner that if a cage chamber is to be driven in the opposite direction to that in which said cage frame is being driven by said hoist, said cage chamber position control device begins to accelerate while said cage frame is operating at constant speed, decelerates when said cage frame begins to decelerate, and finishes decelerating at the same time as said cage frame does.

10. The double-deck elevator car according to claim 8, wherein said hoist control device is further configured to control said hoist in such a manner that while said cage chamber drive device is operating, a deceleration of said cage frame is smaller than a rated deceleration of said standard elevator car.

11. The double-deck elevator car according to claim 10, wherein said hoist control device and cage chamber position control device are further configured to control said hoist and cage chamber drive device respectively in such a manner that when a cage chamber begins to decelerate, a sum of said deceleration and that of said cage frame is substantially equal to said rated deceleration of said standard elevator car.

12. The double-deck elevator car according to claim 9, wherein said cage chamber position control device is further configured to control said cage chamber drive device in such a manner that there is no change in a deceleration of said cage chambers when said hoist causes said cage frame to begin to decelerate.

13. The double-deck elevator car according to claim 3, wherein said cage chamber position control device is further configured to control said cage chamber drive device in such a manner that both said cage chambers begin to accelerate in mutually opposite directions as soon as said cage frame begins to decelerate, and said hoist control device is further configured to control said cage frame in such a manner as to increase a deceleration of said cage frame which is decelerating at a point when said cage chambers finish accelerating.

14. The double-deck elevator car according to claim 13, wherein said cage chamber position control device is further configured to control said cage chamber drive device in such a manner that there is no change in an acceleration of whichever of said cage chambers is being driven in a direction of travel when said cage frame to begins to decelerate.

15. The double-deck elevator car according to claim 13, wherein said hoist control device is further configured to control said hoist in such a manner as to increase a deceleration of said cage frame so that there is no change in an acceleration of whichever of said cage chambers is being driven in the opposite direction to a direction of travel when said cage chambers switch from acceleration to deceleration.

16. The double-deck elevator car according to claim 13, wherein said hoist control device is further configured to control said hoist in such a manner that a deceleration of whichever of said cage chambers is being driven in a direction of travel when said cage chambers switch from acceleration to deceleration is substantially equal to said rated deceleration of said standard elevator car.

17. The double-deck elevator car according to any one of claims 1–4, and 8–16, wherein said hoist control device or said cage chamber position control device is further configured to control, respectively, said hoist or said cage chamber drive device in such a manner as to impart a jerk to an acceleration change when said hoist causes said acceleration of said cage frame to change or said cage chamber drive device causes said acceleration of said cage chamber to change.

18. A double-deck elevator car, comprising:

a hoist configured to raise and lower a cage frame on which are mounted two vertically arranged cage chambers;

a hoist control device configured to control said hoist and a speed of raising and lowering of said cage frame;

a cage chamber drive device configured to drive at least one of the vertically arranged cage chambers in relation to said cage frame so as to alter a relative distance between said two cage chambers; and a cage chamber position control device configured to control said cage chamber drive device, wherein said cage chamber position control device is further configured to control said cage chamber drive device in such a manner that said cage chamber position control device starts to operate at substantially the same time as said hoist switches from constant speed to deceleration, and stops operating at substantially the same time as said hoist stops.

19. The double-deck elevator car according to claim 4 or claim 18, wherein said cage chamber position control device is further configured to control said cage chamber drive device in such a manner that said cage chamber drive device causes a distance between said two cage chambers to change at a constant speed while said hoist is operating at a fixed deceleration in order for said cage frame to stop.

20. The double-deck elevator car according to claim 4 or claim 18, wherein said cage chamber position control device is further configured to control said cage chamber drive device in such a manner that said cage chamber drive device accelerates said cage chambers to allow said cage chambers to reach a constant speed during a time required for said hoist to start to decelerate and to reach a fixed deceleration.

21. The double-deck elevator car according to claim 4, wherein said cage chamber position control device is further configured to calculate and determine an acceleration, constant speed and deceleration of said cage chambers from data relating to an interval between stories for destination floors as stored in said memory device and data relating to a time required for said hoist to decelerate said cage frame, thus controlling said cage chamber drive device.

22. The double-deck elevator car according to claim 20, wherein said hoist control device is further configured to control a rate of acceleration change when said hoist switches from constant speed to deceleration in such a manner that a rate of said hoist is not more than a rate of acceleration change if said cage chamber drive device does not operate.

23. The double-deck elevator car according to claim 18, wherein said cage chamber drive device is configured to drive only one of said two cage chambers in the same direction as said cage frame.

24. The double-deck elevator car according to claim 18, wherein said cage chamber drive device is configured to drive both said cage chambers in mutually opposite directions.

25. The double-deck elevator car according to claim 18, wherein said cage chamber position control device is housed withein said hoit control device.

* * * * *